US010355429B2

(12) United States Patent
Kim et al.

(10) Patent No.: US 10,355,429 B2
(45) Date of Patent: Jul. 16, 2019

(54) CONNECTION TERMINAL DEVICE AND ELECTRONIC DEVICE HAVING THE SAME

(71) Applicants: SAMSUNG ELECTRONICS CO., LTD., Suwon-si, Gyeonggi-do (KR); HYUPJINCONNECTOR CO., LTD., Ansan-si, Gyeonggi-do (KR)

(72) Inventors: Myeong-Hwa Kim, Suwon-si (KR); Yang-Jean Park, Suwon-si (KR); Yeon-Kwan Moon, Daegu (KR); Jin-Woo Park, Seongnam-si (KR); Myung-Suk Bae, Siheung-si (KR); Jung-Hyun Cho, Siheung-si (KR); Jin-Hyuk Choi, Yongin-si (KR); Jae-Ryong Han, Hwaseong-si (KR); Jang-Won Hur, Seoul (KR)

(73) Assignees: SAMSUNG ELECTRONICS CO., LTD., Suwon-si (KR); HYUPJINCONNECTOR CO., LTD., Ansan-si (KR)

( * ) Notice: Subject to any disclaimer, the term of this patent is extended or adjusted under 35 U.S.C. 154(b) by 0 days.

(21) Appl. No.: 15/657,006

(22) Filed: Jul. 21, 2017

(65) Prior Publication Data

US 2018/0026406 A1 Jan. 25, 2018

(30) Foreign Application Priority Data

Jul. 22, 2016 (KR) ..... 10-2016-0093726

(51) Int. Cl.

*H01R 13/73* (2006.01)
*H01R 13/74* (2006.01)
*H01R 12/71* (2011.01)
*H01R 13/24* (2006.01)

(52) U.S. Cl.

CPC ..... *H01R 13/74* (2013.01); *H01R 12/71* (2013.01); *H01R 13/2442* (2013.01)

(58) Field of Classification Search

CPC ..... H01R 23/7057; H01R 13/504; H01R 23/7063; H01R 13/748; H01R 12/57
USPC ..... 439/571, 572, 570, 566, 564, 83
See application file for complete search history.

(56) References Cited

U.S. PATENT DOCUMENTS 9,281,591 B2 3/2016 Kurita
2015/0222035 A1* 8/2015 Kurita ..... H05K 9/0016 439/876

FOREIGN PATENT DOCUMENTS

JP 201196908 A 5/2011
KR 101621705 B1 5/2016

* cited by examiner

*Primary Examiner* — Phuong Chi T Nguyen

(57) ABSTRACT

A connection terminal device and an electronic device having the same are provided. The connection terminal device includes a connection terminal device body, and a connection terminal connected to the connection terminal device body. The connection terminal device also has a front unit disposed on a front surface of the connection terminal device body, a rear unit disposed on a rear surface of the connection terminal device body, and a support disposed on the rear surface of the connection terminal device body. When force is applied to the connection terminal, supporting force is transferred to the rear unit of the connection terminal device body.

16 Claims, 8 Drawing Sheets

CONNECTION TERMINAL DEVICE AND ELECTRONIC DEVICE HAVING THE SAME

CROSS-REFERENCE TO RELATED APPLICATION AND CLAIM OF PRIORITY

The present application is related to and claims the benefit under 35 U.S.C. § 119(a) of a Korean patent application filed in the Korean Intellectual Property Office on Jul. 22, 2016, and assigned Serial No. 10-2016-0093726, the entire disclosure of which is incorporated herein by reference.

TECHNICAL FIELD

The present disclosure relates to a connection terminal device mounted in an electronic device.

BACKGROUND

In general, various electronic devices such as a portable phone, an MP3 player, a portable multimedia player (PMP), a tablet personal computer (PC), Galaxy Tab, iPad, and an e-book reader adopt a connection terminal device in order to electrically connect to an external lead line.

In the connection terminal device, a base plate fixed to a board and an operation unit connected vertically movably to an object form the shape of a C-clip on the whole. The operation unit includes a connection part directly contacting an object, an elastic part that provides elasticity to the connection part, when the connection part contacts the object, and an absorption surface that connects the connection part to the elastic part.

When an external object is connected to the connection part, the connection terminal device may appropriately distribute deformation load through elastic deformation of the elastic part, and enables smooth connection between the connection part and the object by balancing the connection part. In this manner, the connection terminal device electrically connects electronic parts to each other.

In the conventional C-clip-shaped connection terminal, however, one end of the connection part is a free end which is not restrained, spaced from the base plate by a predetermined gap. Therefore, as the whole operation unit including the connection part is pressed down or lifted up excessively by a force applied from top to bottom, from bottom to top, from the front of the connection part, or from a side of the connection part, the resulting deformation of the connection terminal device causes frequent connection failures.

That is, because the conventional C-clip-shaped connection terminal device is so configured that the operation unit may move only upward or downward, it does not electrically connect a side of an electronic part to a side of another electronic part. As a result, the layout and design of a product are not made freely.

Accordingly, there is a need for a connection terminal device capable of electrically connecting electronic parts to each other in a sidewise direction, for the purpose of free layout and design of electronic parts, compared to a conventional connection terminal device that connects electronic parts to each other only in a vertical direction.

The above information is presented as background information only to assist with an understanding of the present disclosure. No determination has been made, and no assertion is made, as to whether any of the above might be applicable as prior art with regard to the present disclosure.

SUMMARY

To address the above-discussed deficiencies, it is a primary object to provide a connection terminal device in which a connection terminal is configured to be movable forward and backward in a connection terminal device body, so that the connection terminal may move back and forth, compared to a conventional connection terminal that moves only upward and downward, and thus make an electrical connection between sides of electronic parts, thereby enabling free layout and design of electronic parts of a product, and an electronic device having the connection terminal device.

In accordance with an aspect of the present disclosure, there is provided a connection terminal device. The connection terminal device includes a connection terminal device body, a connection terminal connected to the connection terminal device body, a front unit disposed on a front surface of the connection terminal device body, a rear unit disposed on a rear surface of the connection terminal device body, and a support disposed on the rear surface of the connection terminal device body, for when force of the connection terminal is applied, supporting force transferred to the rear unit of the connection terminal device body.

In accordance with another aspect of the present disclosure, there is provided a connection terminal device. The connection terminal device includes a connection terminal device body, a connection terminal curvedly connected to the connection terminal device body, for electrically connecting to an external object by moving forward and backward by elastic force, a front unit disposed on a front surface of the connection terminal device body, for allowing a part of the connection terminal to protrude outward, a rear unit disposed on a rear surface of the connection terminal device body, for contacting the connection terminal along with forward and backward movement of the connection terminal and restricting the forward and backward movement of the connection terminal, and at least one support provided in the connection terminal device body, for supporting the connection terminal device body during the forward and backward movement of the connection terminal.

In accordance with another aspect of the present disclosure, there is provided a method for operating a connection terminal device. The method includes providing a connection terminal connected to a connection terminal device body and electrically connected to an external object by moving forward and backward by elastic force, fixing at least one rear support provided on a rear surface of the connection terminal device body onto a board by welding, and fixing at least one side support provided on a side surface of the connection terminal device body onto the board by welding, and when a connection terminal provided in the connection terminal device body contacts an external object, pushing the connection terminal forward and backward, supporting force transferred to the rear surface of the connection terminal device body by the at least one rear support, and supporting force transferred to the side surface of the connection terminal device body by the at least one side support.

In accordance with another aspect of the present disclosure, there is provided a connection terminal device in an electronic device. The connection terminal device includes a board provided in the electronic device, a connection terminal device body fixed to the board, a connection terminal curvedly connected to the connection terminal device body, for electrically connecting to an external object by moving forward and backward by elastic force, a front unit disposed on a front surface of the connection terminal device body, for allowing a part of the connection terminal to protrude outward, a rear unit disposed on a rear surface of the connection terminal device body, for contacting the connection terminal along with forward and backward movement of the connection terminal and restricting the forward and backward movement of the connection terminal, and at least one support provided in the connection terminal device body, for supporting the connection terminal device body during the forward and backward movement of the connection terminal.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
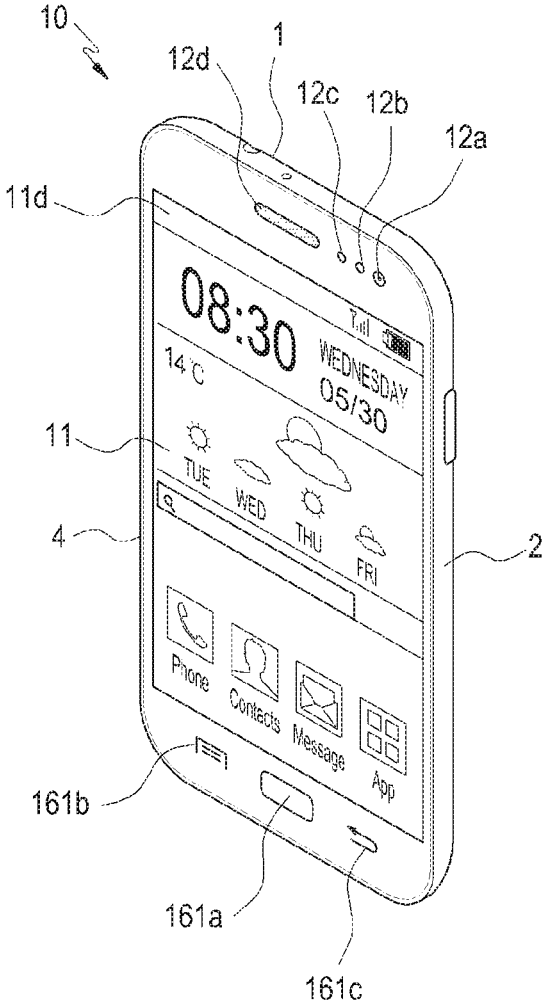
FIG. 1 is a perspective view illustrating the front surface of an electronic device having a connection terminal device according to various embodiments of the present disclosure.

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device.

Terms used in various embodiments of the present disclosure will first be described in brief, followed by a detailed description of various embodiments of the present disclosure.

Although terms used in various embodiments of the present disclosure are general terms selected in consideration of their functions in various embodiments of the present disclosure, they may vary according to the intent of a user or an operator, the customs, or emergence of new technologies. In certain cases, there are terms that the applicant has arbitrarily selected, and their meanings will be described in detail in the following description. Therefore, the terms used in various embodiments of the present disclosure may be defined by the appended claims and their equivalents, not by their names.

The term as used in the present disclosure, 'first' or 'second' may modify the names of various components, not limiting the components. These expressions may be used to distinguish one component from another component. For example, a first component may be referred to as a second component and vice versa without departing from the scope of the present disclosure.

Application examples of an electronic device according to an embodiment of the present disclosure may include all mobile communication terminals operating in conformance with communication protocols of various mobile communication systems, all information and communication devices, multimedia devices, and their application devices, such as a video phone, an e-book reader, a laptop personal computer (PC), a netbook computer, a personal digital assistant (PDA), a portable multimedia player (PMP), an MPEG-1 audio layer-3 (MP3) player, a mobile medical equipment, a camera, or a wearable device (for example, a head-mounted device (HMD) like electronic glasses, electronic clothes, an electronic necklace, an electronic appcessory, an electronic tattoo, or a smart watch).

According to some embodiments, an electronic device may be a home appliance. For example, the home appliance may be at least one of, for example, a television (TV), a digital versatile disk (DVD) player, an audio player, a refrigerator, an air conditioner, a vacuum cleaner, an oven, a microwave oven, a washer, an air purifier, a set-top box, a TV box (for example, Samsung HomeSync™, Apple TV™, Google TV™, or the like), a game console, an electronic dictionary, an electronic key, a camcorder, or an electronic picture frame.

According to some embodiments, an electronic device may be at least one of a medical device (for example, a magnetic resonance angiography (MRA) device, a magnetic resonance imaging (MRI) device, a computed tomography (CT) device, an imaging device, an ultrasonic device, or the like), a navigation device, a global positioning system (GPS) receiver, an event data recorder (EDR), a flight data recorder (FDR), an automotive infotainment device, a naval electronic device (for example, a naval navigation device, a gyrocompass, or the like), an avionic electronic device, a security device, an in-vehicle head unit, an industrial or consumer robot, an automatic teller machine (ATM) in a financial facility, or a point of sales (POS) device in a shop.

According to some embodiments, an electronic device may be at least one of furniture, part of a building/structure, an electronic board, an electronic signature receiving device, a projector, and various measuring devices (for example, water, electricity, gas or electro-magnetic wave measuring devices).

According to various embodiments of the present disclosure, an electronic device having a plurality of built-in parts may be one or a combination of two or more of the foregoing devices. According to various embodiments of the present disclosure, an electronic device may be a flexible device. In addition, it will be apparent to one having ordinary skill in the art that an electronic device according to various embodiments of the present disclosure is not limited to the foregoing devices.

Figure 2:
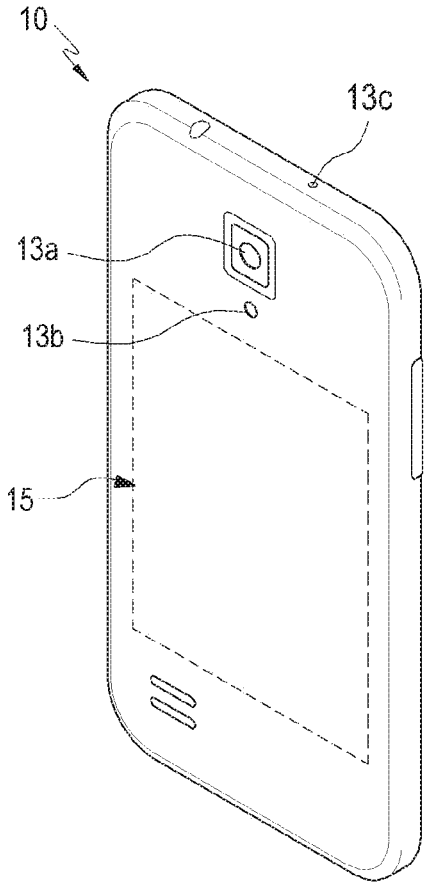
FIG. 2 is a perspective view illustrating the rear surface of the electronic device having the connection terminal device according to various embodiments of the present disclosure.

FIG. 1 is a perspective view illustrating the front surface of an electronic device, and FIG. 2 is a perspective view illustrating the rear surface of the electronic device. In FIGS. 1 and 2, an electronic device 10 may be a smartphone or a wearable device. With reference to FIGS. 1 and 2, components of the electronic device 10 such as a smartphone will be described below.

As illustrated in FIG. 1, a touch screen 11 may be disposed at the center of the front surface of the electronic device 10. The touch screen 11 may occupy almost the entirety of the front surface of the electronic device 10. In FIG. 1, a main home screen is displayed on the touch screen 11, by way of example. The main home screen is the first screen to be displayed on the touch screen 11 when the electronic device 10 is powered on. In the case where the electronic device 10 has different home screens on a plurality of pages, the main home screen may be the first of the home screens on the plurality of pages. Shortcut icons for executing frequently used applications, a main menu switch key, time, weather, and the like may be displayed on the home screen. The main menu switch key may display a menu screen on the touch screen 11. Also, a status bar 11*d* may be displayed at the top of the touch screen 11 in order to indicate states such as a battery charged state, a received signal strength, and current time. A home key 161*a*, a menu button 161*b*, and a back button 161*c* may be formed at the bottom of the touch screen 11.

The home key 161*a* may be used to display the main home screen on the touch screen 11. For example, upon touching of the home key 161*a* while any home screen other than the main home screen or a menu screen is displayed on the touch screen 11, the main home screen may be displayed on the touch screen 11. Upon touching of the home key 161*a* during execution of applications on the touch screen 11, the main home screen may be displayed on the touch screen 11. The home key 161*a* may also be used to display recently used applications or a task manager on the touch screen 11. The menu button 161*b* may provide link menus available on the touch screen 11. The link menus may include a widget adding menu, a background changing menu, a search menu, an edit menu, an environment setting menu, and the like. The back button 161*c* may be used to display a screen executed previously to a current screen or end the latest used application.

According to various embodiments of the present disclosure, a first camera 12*a*, an illumination sensor 12*b*, a proximity sensor 12*c*, or a speaker 12*d* may be included at a top end of the front surface of the electronic device 10, whereas a second camera 13*a*, a flash 13*b*, or a speaker 13*c* may be included on the rear surface of the electronic device 10. If a battery pack is detachably attached to the electronic device 10, the bottom surface of the electronic device 10 may be a detachable battery cover 15.

The electronic device 10 which will be described below may be any of the afore-described wearable device, laptop computer, netbook computer, smartphone, tablet PC, Galaxy Tab, and iPad. In the embodiment, the electronic device 10 may be a smartphone.

Further, the electronic device may have a display unit which is made large and has a sophisticated design through minimization of a bezel area, a flexible display unit, or a concave or convex display unit.

For example, edges of the display unit may be bent so that a view area may be extended to the side surfaces of the display unit. As a consequence, the view area may be extended or additional screens may be provided on the side surfaces of the display unit, and high-quality design may be achieved. According to an embodiment, the display unit includes a first view area, and second view areas on both sides of the first view area.

The previously described electronic device 10 may include a connection terminal device (100 in FIG. 3) on a board (10*a* in FIG. 3) of the electronic device 10, and the connection terminal device may include a connection terminal electrically connected to an external object. In the embodiment, the connection terminal device is described in the context of, but not limited to, a connection terminal provided in the above-described electronic device. For example, as far as the connection terminal device is a connection terminal which is electrically connected, the connection terminal device is applicable to any device other than the above-disclosed electronic device. Herein, various embodiments of the present disclosure will be described in the context of a connection terminal device of an electronic device capable of communications.

Figure 3:
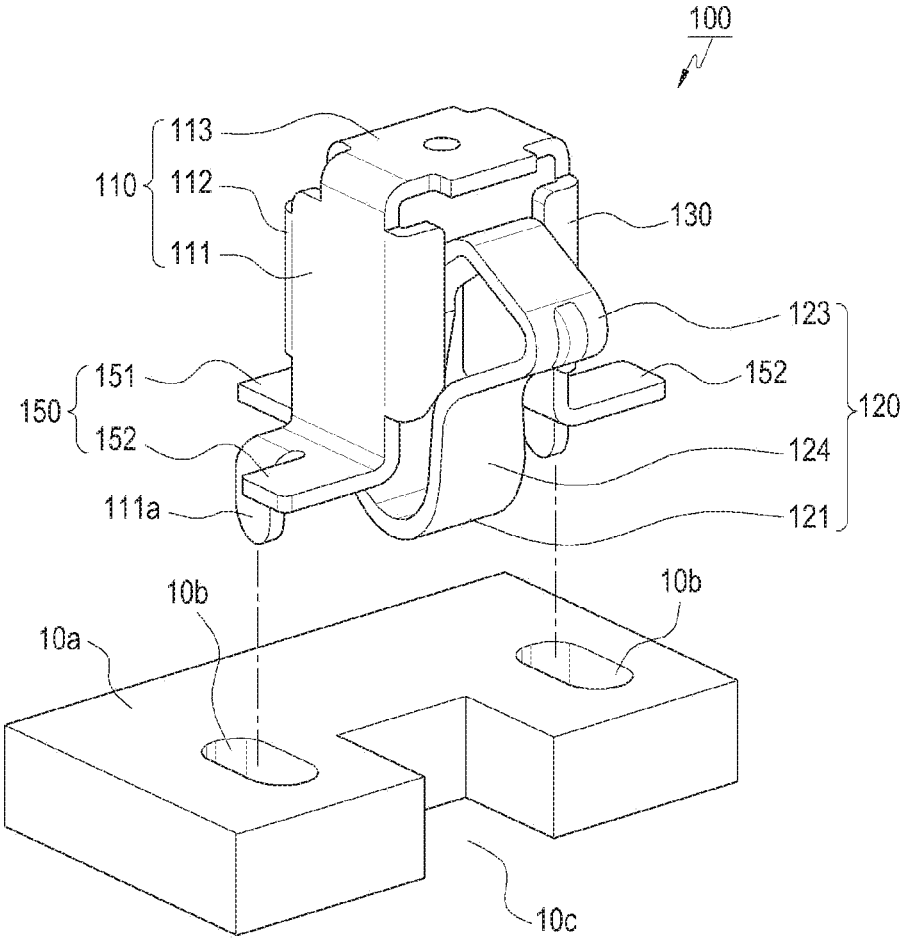
FIG. 3 is an exploded perspective view illustrating the structure of a connection terminal device according to various embodiments of the present disclosure.
Figure 4:
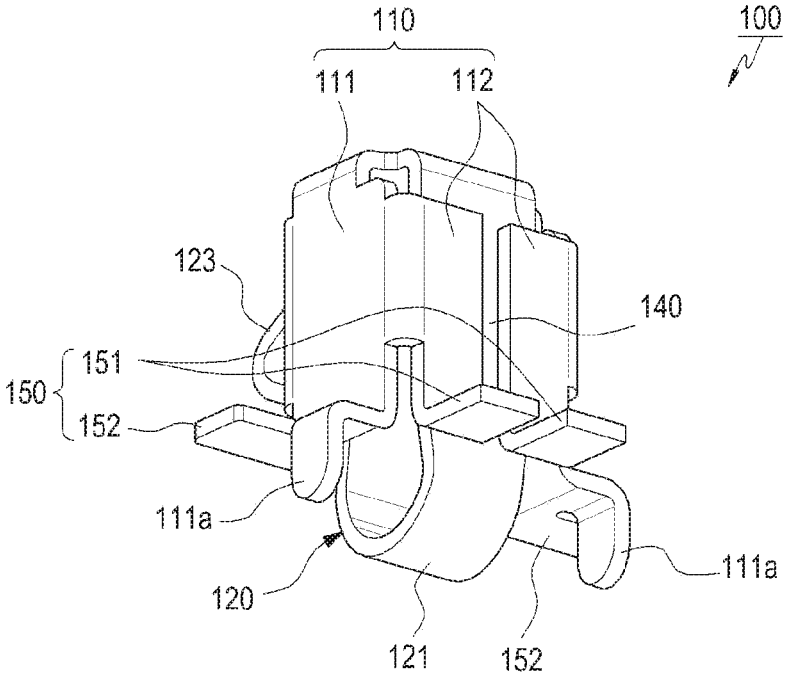
FIG. 4 is a perspective view illustrating the rear surface of the connection terminal device according to various embodiments of the present disclosure.

FIG. 3 is an exploded perspective view illustrating the structure of a connection terminal device 100 according to various embodiments of the present disclosure, and FIG. 4 is a perspective view illustrating the rear surface of the connection terminal device 100 according to various embodiments of the present disclosure.

Referring to FIGS. 3 and 4, the connection terminal device 100 provided in the electronic device 10 may include a connection terminal device body (hereinafter, referred to shortly as a body) 110, a connection terminal 120, a front unit 130, a rear unit 140, and at least one support 150. The body 110 may be connected to the connection terminal 120, surrounding a part of the connection terminal 120.

The connection terminal 120 may be connected in a bent shape to the body 110, so that the connection terminal 120 may move forward and backward by elastic force and thus be connected electrically to an external object 160. The front unit 130 may be disposed on the front surface of the body 110 in order to allow a part of the connection terminal 120 to protrude outward and prevent distortion of the connection terminal 120 during the forward and backward movement of the connection terminal 120 with respect to the body 110. For example, when the connection terminal 120 is brought into contact with the external object 160 and thus the external object 160 is inserted and pushed into the body 110 and then removed from the connection terminal 120, the connection terminal 120 is recovered by elastic force. Herein, the connection terminal 120 may be distorted sideways, and the distortion may be prevented by the front unit 130. That is, when the connection terminal 120 is recovered by moving forward and backward by elastic force, the front unit 130 may guide the movement of the connection terminal 120, while preventing distortion of the connection terminal 120. The rear unit 140 may be provided on the rear surface of the body 110 to contact the connection terminal 120 during the forward and backward movement of the connection terminal 120, thereby restricting the movement of the connection terminal 120. For example, when the external object 160 contacts the connection terminal 120 and applies push-back force to the connection terminal 120, a part of the connection terminal 120 may contact a part of the rear unit 140 of the body 110. The at least one support 150 may be provided on the rear surface of the body 110 to support push-hack force applied to the rear unit 140 during backward movement of the connection terminal 120. Further, the at least one support 150 may be provided on a side surfaces of the body 110 to support force applied to the side surface of the connection terminal 120. For example, when the external object 160 contacts the connection terminal 120, while pushing the connection terminal 120, the push force may be transferred to the rear unit 140, being supported by the at least one support 150.

As the connection terminal 120 is configured to electrically connect to the external object 160 through forward and backward movement by elastic force with respect to the body 110 as described above, the connection terminal 120 may be provided between parts of the electronic device 10, thus enabling contact between side surfaces of the parts. Therefore, the layout and design of the product may be made freely, and deformation failure and contact failure of the product may be prevented as well.

The body 110 will be described in greater detail with reference to FIGS. 3 and 4.

Referring to FIGS. 3 and 4, the body 110 may include sidewalk 111, rear walls 112, and a top wall 113. The sidewalls 111 may be provided on both side surfaces of the body 110, surrounding and protecting a part of the connection terminal 120.

The rear walls 112 may be provided on the rear surface of the body 110, surrounding the rear unit 140 of the connection terminal 120, in order to protect and support the rear surface of the connection terminal 120.

The top wall 113 may be formed on the top surface of the body 110, curved at right angles in order to protect the top surface of the connection terminal 120. For example, the rear walls 112 may be connected integrally to the sidewalls 111, bent by means of first curved parts formed on side surfaces of the sidewalls 111, and the top wall 113 may be connected integrally to the sidewalk 111, bent by second curved portions formed on top surfaces of the sidewalk 111.

A pair of sidewalls 111 may be disposed on both sides of the rear walls 112, facing each other symmetrically. The top wall 113 may be bent perpendicularly to the rear walls 112.

The sidewalls 111 may sufficiently surround at least a part of the connection terminal 120. The sidewalls 111 may be provided in a manner that allows a connection movement portion 123 of the connection terminal 120 to protrude outward. Therefore, the connection terminal device 100 may protect the connection terminal 120 from forces applied in left and right directions by means of the sidewalls 111.

Further, a pair of board connection parts 111*a* may be provided at ends of the sidewalls 111, to be engaged with and electrically connected to engagement parts 10*b* formed on the board 10*a* of the electronic device 10. For example, the engagement parts 10*b* may be engagement holes formed on the board 10*a* built in the electronic device 10. When the connection terminal device 100 is installed to the board 10*a*, the pair of board connection parts 111*a* may be inserted into and thus engaged with the engagement parts 10*b*. Herein, the pair of board connection parts 111*a* may fix the connection terminal device 100 to the board 10*a*, while electrically connecting the connection terminal device 100 to the board 10*a*. Further, the pair of board connection parts 111*a* may be simply engaged with the engagement parts 10*b* without electrically connecting the connection terminal device 100 to the board 10*a*, thereby fixing the connection terminal device 100 to the board 10*a*.

With reference to FIGS. 5 to 8, the connection terminal 120 will be described below in greater detail.

Figure 5:
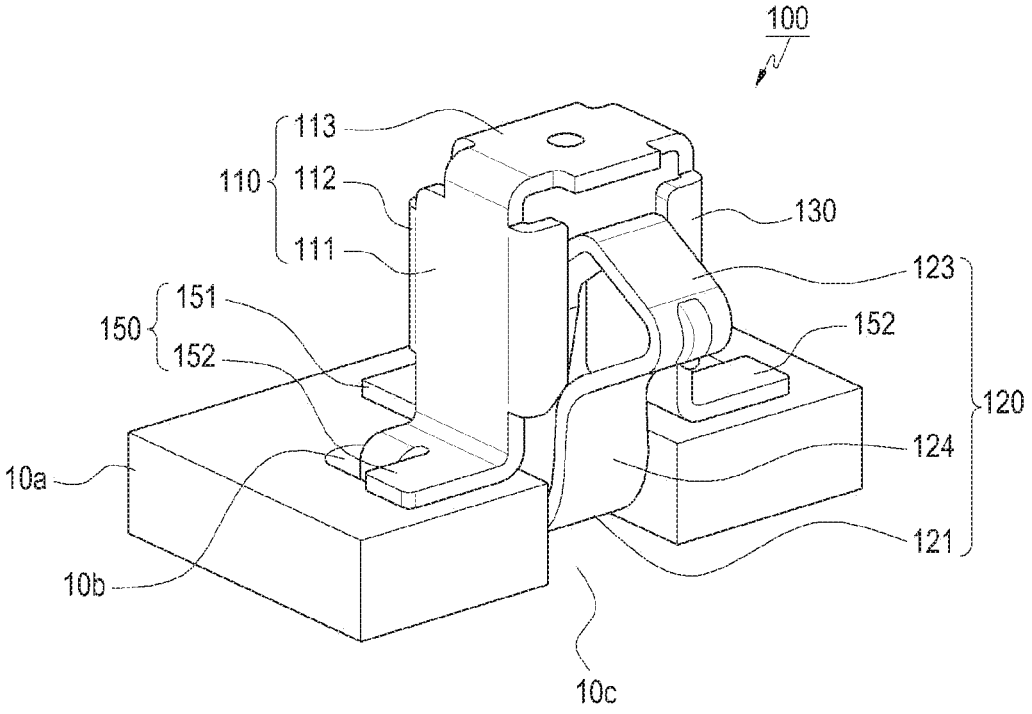
FIG. 5 is a perspective view illustrating the connection terminal device mounted on a board according to various embodiments of the present disclosure.
Figure 6:
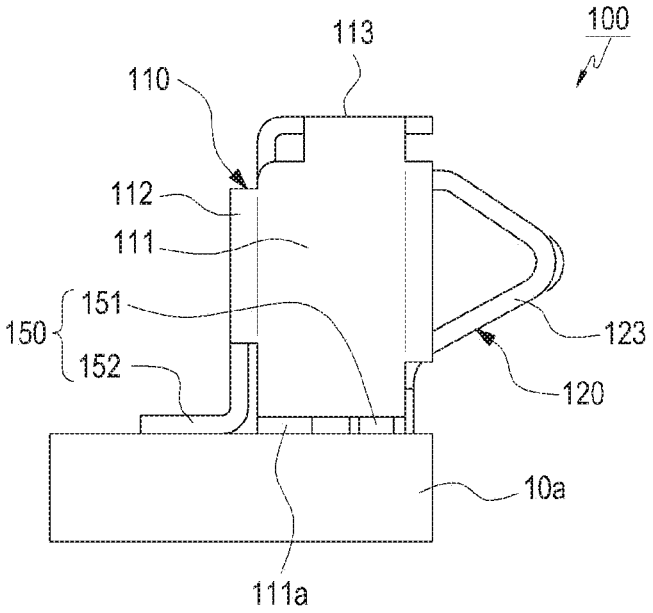
FIG. 6 is a side view illustrating the connection terminal device on the board according to various embodiments of the present disclosure.
Figure 7:
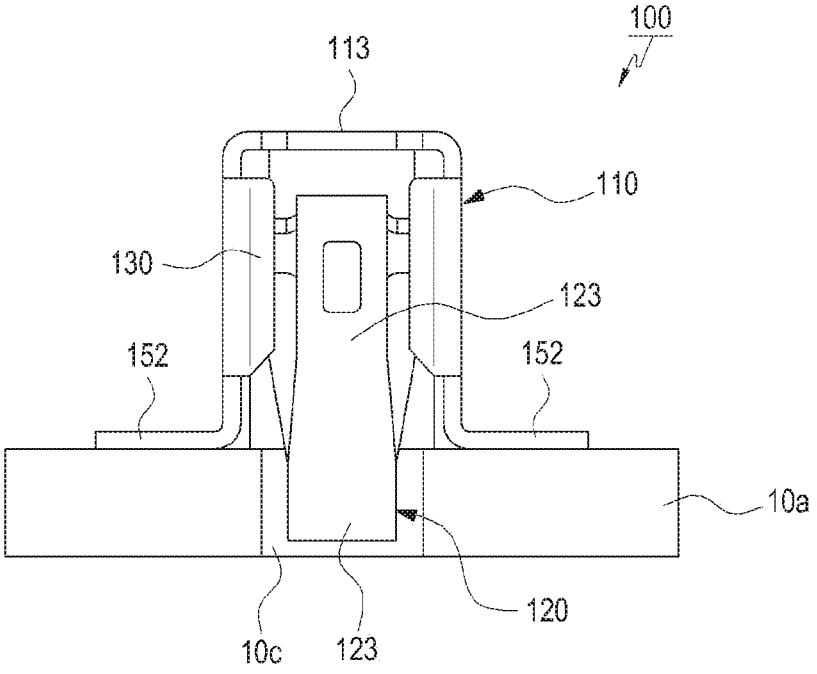
FIG. 7 is a front view illustrating the connection terminal device mounted on the board according to various embodiments of the present disclosure.
Figure 8:
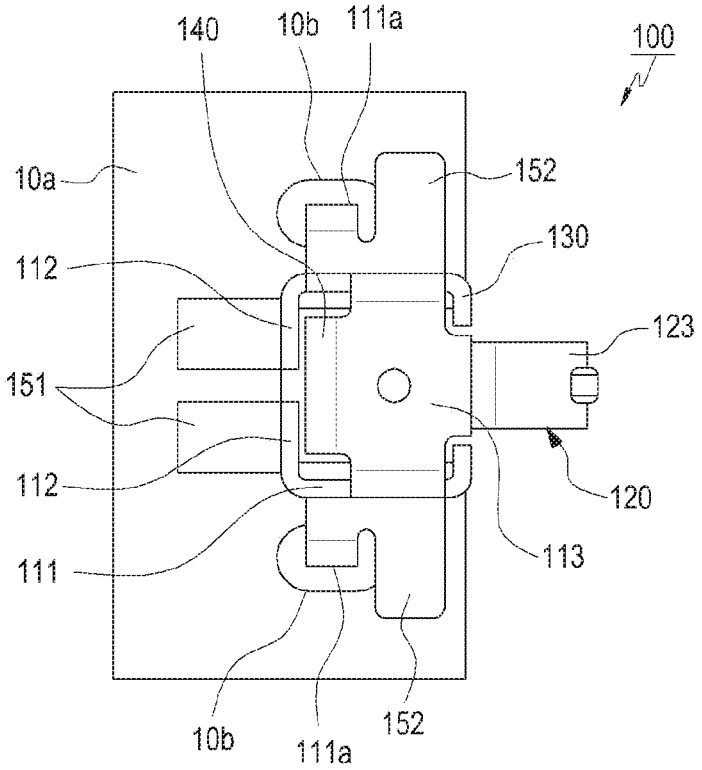
FIG. 8 is a plan view illustrating the connection terminal device mounted on the board according to various embodiments of the present disclosure.

FIG. 5 is a perspective view illustrating the connection terminal device 100 mounted on the board 10*a* according to various embodiments of the present disclosure, FIG. 6 is a side view illustrating the connection terminal device 100 mounted on the board 10*a* according to various embodiments of the present disclosure, FIG. 7 is a front view illustrating the connection terminal device 100 mounted on the board 10*a* according to various embodiments of the present disclosure, and FIG. 8 is a plan view illustrating the connection terminal device 100 mounted on the board 10*a* according to various embodiments of the present disclosure.

Referring to FIGS. 5 to 8, the connection terminal 120 may include an elastic portion 121, the connection movement portion 123, and an absorption surface 124. The elastic portion 121 may be connected in a bent shape to the rear unit 140 of the body 110, and provide elastic force to the connection terminal 120 so that the connection terminal 120 may move forward and backward. The connection movement portion 123 may be extended from the elastic portion 121 so that when connecting electrically to the external object 160, the connection movement portion 123 may move forward and backward by elastic force of the elastic portion 121. The absorption surface 124 may be interposed between the elastic portion 121 and the connection movement portion 123 to integrally connect the elastic portion 121 to the connection movement portion 123. For example, the elastic portion 121 may be bent upward from under the sidewalls 111 of the body 110. The elastic portion 121 may be shaped into 'U'. In the embodiment, the elastic portion 121 may be formed into a shape other than 'U'. For example, as far as the elastic portion 121 is configured to provide elastic force to the connection movement portion 123, the elastic portion 121 is applicable to various modified embodiments.

The elastic portion 121 may be engaged in an insertion part 10*c* formed on the board 10*a* of the electronic device 10.

The at least one support 150 will be described below in greater detail with reference to FIGS. 5 to 8.

Referring to FIGS. 5 to 8, the at least one support 150 may include at least one rear support 151 and at least one side support 152.

As illustrated in FIGS. 5, 7 and 8, the at least one side support 152 may be disposed on a side surface of the body 110 so that when the connection terminal 120 moves forward and backward by received force, the at least one side support 152 may support force transferred to the side surface of the body 110.

As illustrated in FIGS. 5, 6 and 8, the at least one rear support 151 may be disposed on the rear surface of the body 110 so that when the connection terminal 120 moves forward and backward by received force, the at least one rear support 151 may support force transferred to the rear surface of the body 110.

For example, the at least one rear support 151 and the at least one side support 152 may be fixed onto the top surface of the board 10*a* of the electronic device 10 by welding. In this state, if the external object 160 pushes back and forth the connection terminal 120 in contact with the connection terminal 120, the connection terminal 120 may be inserted into the body 110, while moving back and forth by received force, and then contact the rear unit 140. Herein, the force transferred to the rear surface of the body 110 may be supported by the at least one rear support 151, and the force transferred to the side surface of the body 110 may be supported by the at least one side support 152. Accordingly, the connection terminal 120 may be stably fixed to the board 10*a* by the at least one rear support 151 and the at least one side support 152, thus being maintained in contact with the board 10*a* without being removed from the board 10*a*.

In other words, the sidewalls 111, the rear walls 112, and the top wall 113 of the body 110 protect the connection terminal 120, and restrict an abnormal movement of the connection terminal 120 caused by forces applied to the connection terminal 120 from various directions along with contact between the external object 160 and the connection terminal 120. Since the at least one rear support 151 and the at least one side support 152 are fixed to the board 10*a* by welding, the at least one rear support 151 and the at least one side support 152 prevent push-out of the connection terminal 120 by supporting the connection terminal 120. Therefore, the connection terminal 120 may be kept stably connected.

Assembly and an operation of the connection terminal device 100 in the electronic device 10 in this state will be described below in greater detail.

Figure 9:
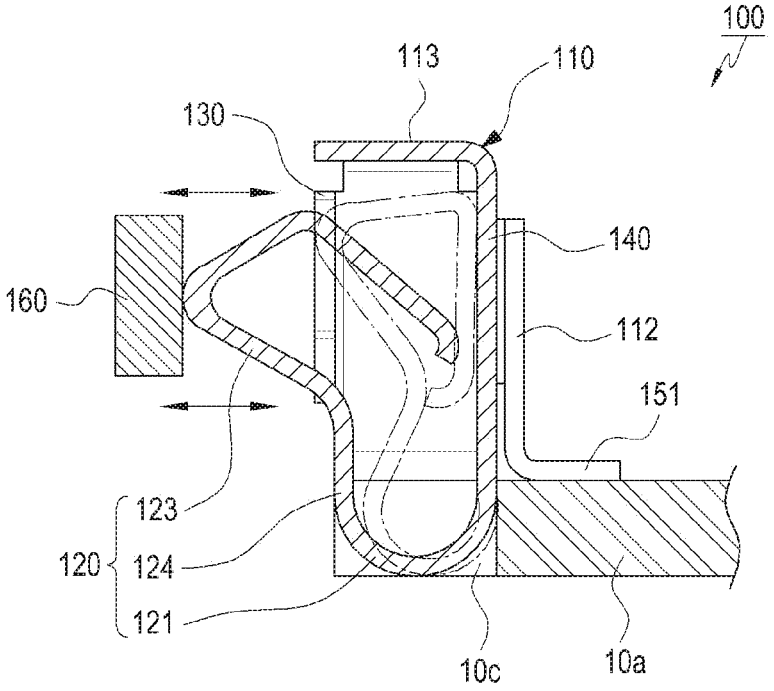
FIG. 9 is a side sectional view illustrating an operation state of the connection terminal device according to various embodiments of the present disclosure.
Figure 10:
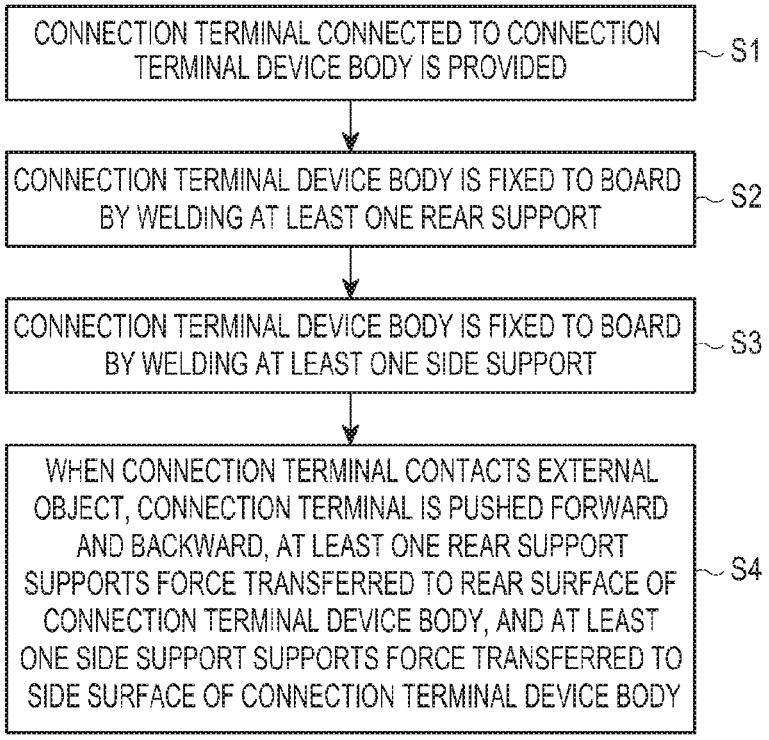
FIG. 10 is a flowchart illustrating a method for operating the connection terminal device according to various embodiments of the present disclosure.

FIG. 9 is a side sectional view illustrating an operation state of the connection terminal device 100 according to various embodiments of the present disclosure, and FIG. 10 is a flowchart illustrating a method for operating the connection terminal device 100 according to various embodiments of the present disclosure.

Referring to FIG. 10, the connection terminal device of the present disclosure may be provided with the connection terminal 120 which is connected to the body 110 and electrically connected to the external object 160 by moving back and forth by elastic force in operation S1.

The body 110 may be fixed to the board 10*a* by welding the at least one rear support 151 provided on the rear surface of the body 110 in operation S2, and by welding the at least one side support 152 provided on the side surface of the body 110 in operation S3.

That is, the body 110 may be fixed on the top surface of the board 10*a* by welding the at least one rear support 151 and the at least one side support 152. Herein, the pair of board connection parts 111*a* provided in the body 110 may be engaged with the engagement parts 10*b* formed on the board 10*a*, while being electrically connected to the engagement parts 10*b*. The elastic portion 121 of the connection terminal 120 may be inserted into the insertion part 10*c* of the board 10*a*. Further, the at least one side support 152 and the at least one rear support 151 formed in the body 110 may be fixed on the top surface of the board 10*a* by welding. For example, the bottom surface of the at least one side support 152 and the bottom surface of the at least one rear support 151 may be fixedly welded on the top surface of the board 10*a*.

In this state, when the external object 160 is brought into contact with the connection terminal 120 provided in the body 110, the connection terminal 120 may be pushed back and forth, the at least one rear support 151 may support force transferred to the rear surface of the body 110, and the at least one side support 152 may support force transferred to the side surface of the body 110 in operation S4.

Now, a description will be given of an operation for bringing the connection terminal device into contact with the external object 160 according to various embodiments of the present disclosure.

As described before with reference to FIG. 9, the connection terminal device 100 may include the connection terminal 120 which is curvedly connected to the connection terminal device body 110 and is electrically connected to the external object 160 by moving back and forth by elastic force.

The connection terminal device may be fixed to the board 10*a* by welding the at least one side support 152 and the at least one rear support 151 to the board 10*a*, and may initially be connected to the external object 160 such as a near field communication (NFC) antenna built in the rear cover of a smartphone. The external object 160 is also applicable to an electronic part other than the NFC antenna.

Herein, as the connection terminal 120 of the connection terminal device 100 mounted on the board 10*a* contacts the external object 160, the connection terminal 120 may be pushed backward. The elastic portion 121 may experience elastic deformation, while absorbing force transferred to the connection terminal 120. Upon completion of the movement of the connection terminal 120, one end of the connection terminal 120 may contact the rear unit 140 of the body 110. The at least one rear support 151 disposed on the rear surface of the body 110 may support force transferred to the rear surface of the body 110.

In this manner, when the connection terminal 120 is moved along with contact with the external object 160, the at least one rear support 151 may prevent the connection terminal 120 from being pushed back to the rear surface of the body 110.

Further, if abnormal force such as an impact imposed on a smartphone fallen on the ground is applied in a contact state between the connection terminal 120 and the external object 160, and then transferred to the side surfaces of the connection terminal 120 as well as the rear surface of the connection terminal 120, the at least one side support 152 provided on a side surface of the body 110 may support the connection terminal 120, and the front unit 130 may prevent slip-off of the connection terminal 120 from the side surfaces of the body 110.

Therefore, even though abnormal force is applied to the connection terminal 120, the force transferred to the connection terminal 120 may be reduced by support of the at least one side support 152. Further, even though the connection terminal 120 is distorted, slip-off of the connection terminal 120 from the body 110 may be prevented by the front unit 130.

That is, deformation of the connection terminal 120 caused by abnormal force, and push-out of the connection terminal 120 in a movement direction may be prevented by the at least one side support 152 and the at least one rear support 151. As a result, the connection terminal 120 may be kept stably connected.

According to various embodiments of the present disclosure, a connection terminal device may include a connection terminal device body, a connection terminal connected to the connection terminal device body, a front unit disposed on a front surface of the connection terminal device body, a rear unit disposed on a rear surface of the connection terminal device body, and a support disposed on the rear surface of the connection terminal device body, for when force of the connection terminal is applied, supporting force transferred to the rear unit of the connection terminal device body.

According to various embodiments of the present disclosure, the connection terminal device body may be connected to the connection terminal, and may surround a part of the connection terminal.

According to various embodiments of the present disclosure, the front unit may prevent the connection terminal from being pushed out forward, and when the force of the connection terminal is applied to the rear unit, a part of the connection terminal may contact a part of the rear unit of the connection terminal device body.

According to various embodiments of the present disclosure, the connection terminal may be U-shaped and positioned in an area formed on a circuit board.

According to various embodiments of the present disclosure, a pair of board connection parts engaged with and electrically connected to a circuit board may be disposed on left and right side surfaces of the connection terminal device body.

According to various embodiments of the present disclosure, a connection terminal device may include a connection terminal device body, a connection terminal cursedly connected to the connection terminal device body, for electrically connecting to an external object by moving forward and backward by elastic force, a front unit disposed on a front surface of the connection terminal device body, for allowing a part of the connection terminal to protrude outward, a rear unit disposed on a rear surface of the connection terminal device body, for contacting the connection terminal along with forward and backward movement of the connection terminal and restricting the forward and backward movement of the connection terminal, and at least one support provided in the connection terminal device body, for supporting the connection terminal device body during the forward and backward movement of the connection terminal.

According to various embodiments of the present disclosure, the connection terminal device body may include sidewalls provided on both side surfaces of the connection terminal device body and surrounding a part of the connection terminal, for protecting both side surfaces of the connection terminal, a rear wall provided on the rear surface of the connection terminal device body and surrounding a rear surface of the connection terminal, for protecting and supporting the rear surface of the connection terminal, and a top wall formed on a top surface of the connection terminal device body, bent at a right angle, for protecting a top surface of the connection terminal.

According to various embodiments of the present disclosure, the connection terminal device may further include a pair of board connection parts at ends of the sidewalls, engaged with and electrically connected to engagement parts formed on a board of an electronic device.

According to various embodiments of the present disclosure, the connection terminal may include an elastic portion connected curvedly to the rear unit of the connection terminal device body, for providing elastic force to move the connection terminal forward and backward, a connection movement portion extended to the elastic portion, for when the connection movement portion is electrically connected to an external object, moving forward and backward by the elastic force of the elastic portion, and an absorption surface provided between the elastic portion and the connection movement portion, for integrally connecting the elastic portion to the connection movement portion.

According to various embodiments of the present disclosure, the elastic portion may be shaped into 'U'.

According to various embodiments of the present disclosure, the elastic portion may be inserted into an insertion part formed on a board of an electronic device.

According to various embodiments of the present disclosure, the at least one support may include at least one rear support disposed on the rear surface of the connection terminal device body, for supporting force transferred to the rear surface of the connection terminal device body during the forward and backward movement of the connection terminal by force transferred to the connection terminal, and at least one side support disposed on a side surface of the body, for supporting force transferred to the side surface of the connection terminal device body during the forward and backward movement of the connection terminal by the force transferred to the connection terminal.

According to various embodiments of the present disclosure, the connection terminal device may further include stoppers on side surfaces of the connection terminal device body, for restricting the forward and backward movement of the connection terminal by being caught in or removed from a pair of catching protrusions protruding from both side surfaces of the connection terminal.

According to various embodiments of the present disclosure, each of the stoppers may include a stopper hole.

According to various embodiments of the present disclosure, a method for operating a connection terminal device may include providing a connection terminal connected to a connection terminal device body and electrically connected to an external object by moving forward and backward by elastic force, fixing at least one rear support provided on a rear surface of the connection terminal device body onto a board by welding, and fixing at least one side support provided on a side surface of the connection terminal device body onto the board by welding, and when a connection terminal provided in the connection terminal device body contacts an external object, pushing the connection terminal forward and backward, supporting force transferred to the rear surface of the connection terminal device body by the at least one rear support, and supporting force transferred to the side surface of the connection terminal device body by the at least one side support.

According to various embodiments of the present disclosure, a connection terminal device in an electronic device may include a board provided in the electronic device, a connection terminal device body fixed to the board, a connection terminal curvedly connected to the connection terminal device body, for electrically connecting to an external object by moving forward and backward by elastic force, a front unit disposed on a front surface of the connection terminal device body, for allowing a part of the connection terminal to protrude outward, a rear unit disposed on a rear surface of the connection terminal device body, for contacting the connection terminal along with forward and backward movement of the connection terminal and restricting the forward and backward movement of the connection terminal, and at least one support provided in the connection terminal device body, for supporting the connection terminal device body during the forward and backward movement of the connection terminal.

Figure 11:
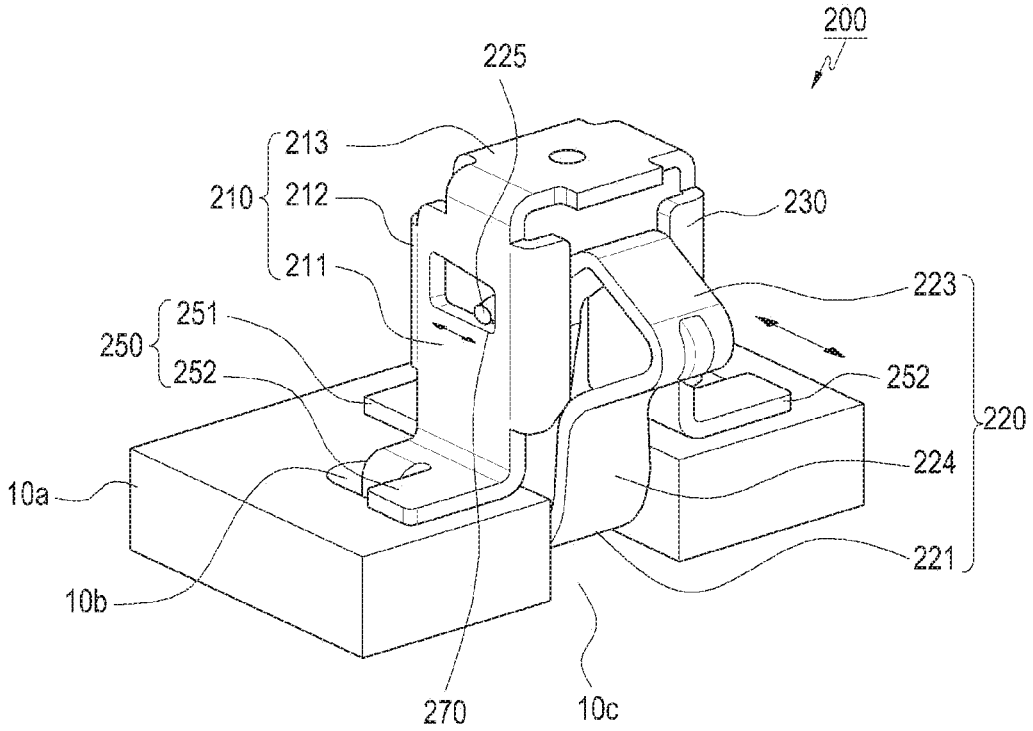
FIG. 11 is a perspective view illustrating the structure of a connection terminal device according to various embodiments of the present disclosure.
Figure 12:
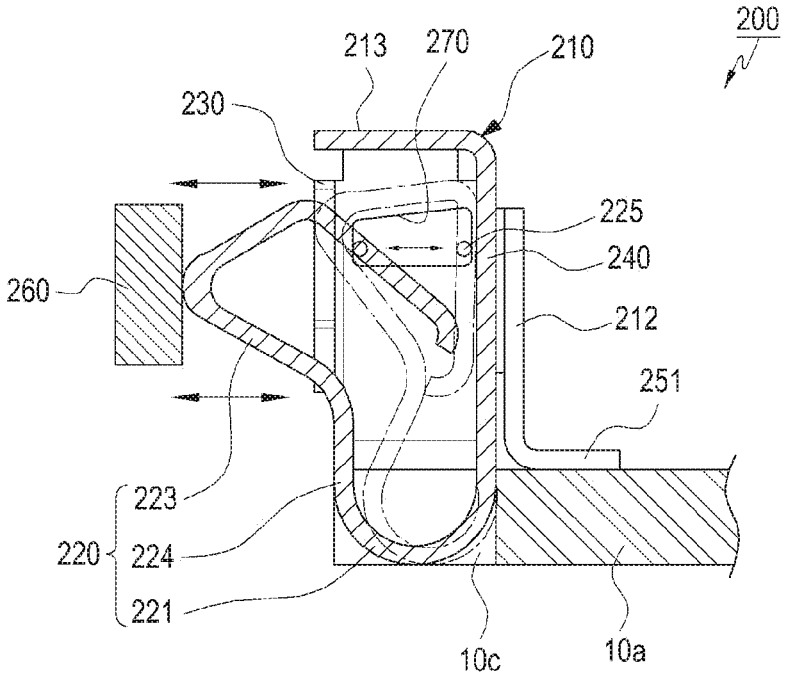
FIG. 12 is a side sectional view illustrating an operation state of the connection terminal device according to various embodiments of the present disclosure.

FIG. 11 is a perspective view illustrating the structure of a connection terminal device 200 according to other various embodiments of the present disclosure, and FIG. 12 is a side sectional view illustrating an operation state of the connection terminal device 200 according to other various embodiments of the present disclosure.

Referring to FIGS. 11 and 12, the connection terminal device 200 provided in an electronic device (10 in FIGS. 1 and 2) may include a connection terminal device body (hereinafter, referred to shortly as a body) 210, a connection terminal 220, a front unit 230, a rear unit 240, at least one support 250, and stoppers 270.

The electronic device (10 in FIGS. 1 and 2) may be similar to or identical in structure to the electronic device 10 described in the foregoing embodiment, at least partially.

The body 210 may be connected to the connection terminal 220, surrounding a part of the connection terminal 220. The connection terminal 220 may be connected curvedly to the body 210 so that the connection terminal 220 may be electrically connected to an external object 260 by moving back and forth by elastic force. The front unit 230 may be disposed on the front surface of the body 210 to prevent distortion of the connection terminal 220 during forward and backward movement of the connection terminal 220 with respect to the body 210. For example, as the connection terminal 220 is brought into contact with the external object 260, the front unit 230 is inserted into and pushed in the body 210. When the external object 260 is removed from the connection terminal 220, the connection terminal 220 is recovered by elastic force. Herein, the connection terminal 220 may be distorted sideways, and the front unit 230 may prevent the distortion of the connection terminal 220. That is, the front unit 230 may guide movement of the connection terminal 220, while preventing distortion of the connection terminal 220 during recovery by elastic force-based forward and backward movement. To restrict movement of the connection terminal 220 in contact with the connection terminal 220 during forward and backward movement of the connection terminal 220, the rear unit 240 may be provided on the rear surface of the body 210. For example, when the external object 260 is brought into contact with the connection terminal 220 and applies force to the connection terminal 220, a part of the connection terminal 220 may contact a part of the rear unit 240 of the body 210.

The at least one support 250 may be provided in the body 210, to support the body 210 during forward and backward movement of the connection terminal 220. For example, if the external object 260 contacts and thus pushes back the connection terminal 220, the force may be transferred to the rear unit 240 of the body 210, supported by the at least one support 250.

The at least one support 250 may include at least one rear support 251 and at least one side support 252. The at least one side support 252 may be positioned on a side surface of the body 210 in order to support force transferred to the side surface of the body 210 during forward and backward movement of the connection terminal 220 of the body 210 caused by received force. The at least one rear support 251 may be positioned on the rear surface of the body 210 in order to support force transferred to the rear surface of the body 210 during forward and backward movement of the connection terminal 220 of the body 210 caused by received force. For example, the at least one rear support 251 and the at least one side support 252 may be fixed on the top surface of the board 10*a* of the electronic device 10 by welding. In this state, if the external object 260 contacts the connection terminal 220, pushing back and forth the connection terminal 220, the connection terminal 220 may be inserted into the body 210, while moving back and forth by received force. Herein, force transferred to the rear surface of the body 210 may be supported by the at least one rear support 251, and force transferred to a side surface of the body 210 may be supported by the at least one side support 252. Therefore, the at least one rear support 251 and the at least side support 252 may stably fix the connection terminal 220 to the board (10*a* in FIG. 3), thus keeping the connection terminal 220 in a connected state without removing the connection terminal 220 from the board. Herein, the at least one rear support 251 may firmly support force transferred backward by elastic force of the connection terminal 220.

Specific operations of the body 210, the connection terminal 220, the front unit 230, and the rear unit 240 have been described in the foregoing embodiment, and thus will not be described again herein.

The stoppers 270 may be provided on the side surfaces of the body 210 in order to restrict forward and backward movement of the connection terminal 220 by being caught in or removed from a pair of catching protrusions 225 formed on both side surfaces of the connection terminal 220. For example, the stoppers 270 may include stopper holes, and the pair of catching protrusions 225 may be engaged with the stopper holes, penetrating through the stopper holes. In this state, if the connection terminal 220 moves forward and backward, the pair of catching protrusions 225 may also move forward and backward within the stopper holes. If the pair of catching protrusions 225 contact both ends of the stopper holes, the forward and backward movement of the connection terminal 220 may be restricted.

Referring to FIG. 12, the pair of catching protrusions 225 contact one ends of the stopper units 270 at an initial contact time point of the connection terminal 220. Then if the external object 260 contacts the connection terminal 220, the connection terminal 220 moves backward, and the pair of catching protrusions 225 also move backward. Upon completion of the movement of the connection terminal 220, the pair of catching protrusions 225 contact and are caught in the other ends of the stoppers 270, and thus the movement of the catching protrusions 225 is restricted. As a consequence, movement of the connection terminal 220 is also restricted.

If the connection terminal 220 moves and then contacts the rear unit 240 of the body 210, the at least one side support 252 and the at least one rear support 251 may prevent push-back of the body 210, while supporting the body 210. Therefore, the connected state of the connection terminal 220 may be supported.

If the external object 260 is removed from the connection terminal 220, the connection terminal 220 moves forward by the elastic portion 221. As the pair of catching protrusions 225 move along with the connection terminal 220, the catching protrusions 225 may be removed from the other ends of the stoppers 270. Then, the pair of catching protrusions 225 may be caught again in the one ends of the stoppers 270, thereby restricting movement of the connection terminal 270.

As a consequence, slip-off of the connection terminal 220 from the body 210, and excessive forward and backward movement of the connection terminal 220 may be prevented.

According to various embodiments of the present disclosure, stoppers may be provided on the side surfaces of the body in order to restrict forward and backward movement of the connection terminal by being caught in or removed from a pair of catching protrusions formed on both side surfaces of the connection terminal.

According to various embodiments, each of the stopper units may include a stopper hole.

As is apparent from the foregoing description, according to various embodiments of the present disclosure, a connection terminal is configured to move forward and backward with respect to a connection terminal device body. Therefore, compared to a conventional connection terminal that moves only upward and downward, the connection terminal may electrically connect side surfaces of electronic parts to each other in an electronic device by moving forward and backward. Therefore, the layout and design of electronic parts in a part may be made freely, and even though force is applied upward to the connection terminal, deformation of the connection terminal may be prevented. For example, exterior walls of the connection terminal protect the connection terminal from forces applied from various directions, thereby reducing deformation failure and connection failure of the connection terminal.

Further, when the connection terminal moves forward and backward, at least one support welded on a board prevents slip-off of the connection terminal. Thus, parts of the electronic device may be kept stably connected, thereby increasing product reliability.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A connection terminal device comprising:

a connection terminal device body;

a connection terminal connected to the connection terminal device body;

a front unit disposed on a front surface of the connection terminal device body;

a rear unit disposed on a rear surface of the connection terminal device body; and a support disposed on the rear surface of the connection terminal device body, for when force of the connection terminal is applied, supporting force transferred to the rear unit of the connection terminal device body, wherein the connection terminal device body comprises a rear wall provided on the rear surface of the connection terminal device body and surrounding a rear surface of the connection terminal, for protecting and supporting the rear surface of the connection terminal.

2. The connection terminal device of claim 1, wherein the connection terminal device body is connected to the connection terminal, and surrounds a part of the connection terminal.

3. The connection terminal device of claim 1, wherein the front unit prevents the connection terminal from being pushed out forward, and the rear unit contacts a part of the connection terminal when the force of the connection terminal is applied.

4. The connection terminal device according to claim 1, wherein the connection terminal is U-shaped and positioned in an area formed on a circuit board.

5. The connection terminal device according to claim 1, wherein a pair of board connection parts engaged with and electrically connected to a circuit board are disposed on left and right side surfaces of the connection terminal device body.

6. A connection terminal device comprising: a connection terminal device body;

a connection terminal curvedly connected to the connection terminal device body, for electrically connecting to an external object by moving forward and backward by elastic force;

a front unit disposed on a front surface of the connection terminal device body, for allowing a part of the connection terminal to protrude outward;

a rear unit disposed on a rear surface of the connection terminal device body, for contacting the connection terminal along with forward and backward movement of the connection terminal and restricting the forward and backward movement of the connection terminal; and at least one support provided in the connection terminal device body, for supporting the connection terminal device body during the forward and backward movement of the connection terminal, wherein the connection terminal device body comprises a rear wall provided on the rear surface of the connection terminal device body and surrounding a rear surface of the connection terminal, for protecting and supporting the rear surface of the connection terminal.

7. The connection terminal device according to claim 6, wherein the connection terminal comprises:

an elastic portion connected curvedly to the rear unit of the connection terminal device body, for providing elastic force to move the connection terminal forward and backward;

a connection movement portion extended to the elastic portion, for when the connection movement portion is electrically connected to an external object, moving forward and backward by the elastic force of the elastic portion; and an absorption surface provided between the elastic portion and the connection movement portion, for integrally connecting the elastic portion to the connection movement portion.

8. The connection terminal device according to claim 6, wherein the at least one support comprises:

at least one rear support disposed on the rear surface of the connection terminal device body, for supporting force transferred to the rear surface of the connection terminal device body during the forward and backward movement of the connection terminal by force transferred to the connection terminal; and at least one side support disposed on a side surface of the body, for supporting force transferred to the side surface of the connection terminal device body during the forward and backward movement of the connection terminal by the force transferred to the connection terminal.

9. The connection terminal device according to claim 6, wherein the connection terminal device body comprises:

sidewalls provided on both side surfaces of the connection terminal device body and surrounding a part of the connection terminal, for protecting both side surfaces of the connection terminal; and a top wall formed on a top surface of the connection terminal device body, bent at a right angle, for protecting a top surface of the connection terminal.

10. The connection terminal device according to claim 9, further comprising a pair of board connection parts at ends of the sidewalls, engaged with and electrically connected to engagement parts formed on a board of an electronic device.

11. The connection terminal device according to claim 7, wherein the elastic portion is inserted into an insertion part formed on a board of an electronic device.

12. The connection terminal device according to claim 7, wherein the elastic portion is U-shaped.

13. The connection terminal device according to claim 6, further comprising stoppers on side surfaces of the connection terminal device body, for restricting the forward and backward movement of the connection terminal by being caught in or removed from a pair of catching protrusions protruding from both side surfaces of the connection terminal.

14. The connection terminal device according to claim 13, wherein each of the stoppers includes a stopper hole.

15. A method for operating a connection terminal device, the method comprising: providing a connection terminal connected to a connection terminal device body and electrically connected to an external object by moving forward and backward by elastic force;

fixing at least one rear support provided on a rear surface of the connection terminal device body onto a board by welding, and fixing at least one side support provided on a side surface of the connection terminal device body onto the board by welding; and when a connection terminal provided in the connection terminal device body contacts an external object, pushing the connection terminal forward and backward, supporting force transferred to the rear surface of the connection terminal device body by the at least one rear support, and supporting force transferred to the side surface of the connection terminal device body by the at least one side support, wherein the connection terminal device body comprises a rear wall provided on the rear surface of the connection terminal device body and surrounding a rear surface of the connection terminal, for protecting and supporting the rear surface of the connection terminal.

16. A connection terminal device in an electronic device, comprising:

a board provided in the electronic device;

a connection terminal device body fixed to the board;

a connection terminal curvedly connected to the connection terminal device body, for electrically connecting to an external object by moving forward and backward by elastic force;

a front unit disposed on a front surface of the connection terminal device body, for allowing a part of the connection terminal to protrude outward;

a rear unit disposed on a rear surface of the connection terminal device body, for contacting the connection terminal along with forward and backward movement of the connection terminal and restricting the forward and backward movement of the connection terminal; and at least one support provided in the connection terminal device body, for supporting the connection terminal device body during the forward and backward movement of the connection terminal, wherein the connection terminal device body comprises a rear wall provided on the rear surface of the connection terminal device body and surrounding a rear surface of the connection terminal, for protecting and supporting the rear surface of the connection terminal.

* * * * *